US008449718B2

(12) United States Patent
Nozaki et al.

(10) Patent No.: US 8,449,718 B2
(45) **Date of Patent: *May 28, 2013**

(54) BULKY PAPER WITH CONCAVO-CONVEX PATTERN AND PROCESS FOR PRODUCING THEREOF

(75) Inventors: Satoshi Nozaki, Kanonji (JP); Tsutomu Shirai, Kanonji (JP)

(73) Assignee: Unicharm Corporation, Shikokuchuo-shi (JP)

( * ) Notice: Subject to any disclaimer, the term of this patent is extended or adjusted under 35 U.S.C. 154(b) by 33 days.

This patent is subject to a terminal disclaimer.

(21) Appl. No.: 12/991,673

(22) PCT Filed: Apr. 28, 2009

(86) PCT No.: PCT/JP2009/058718

§ 371 (c)(1),
(2), (4) Date: Dec. 30, 2010

(87) PCT Pub. No.: WO2009/145042

PCT Pub. Date: Dec. 3, 2009

(65) Prior Publication Data

US 2011/0139385 A1 Jun. 16, 2011

(30) Foreign Application Priority Data

May 30, 2008 (JP) ..... 2008-143399

(51) Int. Cl.
*D21H 11/00* (2006.01)

(52) U.S. Cl.
USPC ..... 162/109

(58) Field of Classification Search
None
See application file for complete search history.

(56) References Cited

U.S. PATENT DOCUMENTS

| | | | | |
|---|---|---|---|---|
| 5,331,749 | A | 7/1994 | Thiele | |
| 5,418,257 | A | 5/1995 | Weisman | |
| 6,207,020 | B1 | 3/2001 | Anderson | |
| 6,475,343 | B1 | 11/2002 | Grabscheid et al. | |
| 6,613,195 | B2 | 9/2003 | Anderson | |
| 6,846,529 | B2 | 1/2005 | Mohan et al. | |
| 7,335,279 | B2 | 2/2008 | Mohan et al. | |
| 7,513,975 | B2 | 4/2009 | Burma | |
| 7,553,535 | B2 * | 6/2009 | Noda et al. | 428/156 |
| 7,943,011 | B2 | 5/2011 | Reed et al. | |
| 7,976,523 | B2 * | 7/2011 | Suzuki et al. | 604/385.101 |
| 2001/0008181 | A1 | 7/2001 | Anderson | |
| 2003/0000673 | A1 | 1/2003 | Anderson | |
| 2005/0098284 | A1 | 5/2005 | Heikkinen et al. | |
| 2006/0057365 | A1 | 3/2006 | Swoboda et al. | |
| 2006/0058769 | A1 * | 3/2006 | Suzuki et al. | 604/385.101 |
| 2007/0215678 | A1 | 9/2007 | Swoboda et al. | |
| 2007/0256805 | A1 | 11/2007 | Reed et al. | |
| 2007/0298220 | A1 * | 12/2007 | Noda et al. | 428/152 |
| 2009/0149559 | A1 | 6/2009 | Masuda et al. | |
| 2010/0120929 | A1 | 5/2010 | Naito et al. | |
| 2011/0083819 | A1 | 4/2011 | Nozaki et al. | |

FOREIGN PATENT DOCUMENTS

| | | |
|---|---|---|
| JP | 60-7298 | 1/1985 |
| JP | 60-59198 | 4/1985 |
| JP | 2-264093 | 10/1990 |
| JP | 5-339898 | 12/1993 |
| JP | 7-205543 | 8/1995 |
| JP | 9-1974 | 1/1997 |
| JP | 10-88495 | 4/1998 |
| JP | 2000-34695 | 2/2000 |
| JP | 2001-98494 | 4/2001 |
| JP | 2005-206988 | 8/2005 |
| JP | 2006-28654 | 2/2006 |
| JP | 2009-235627 | 10/2009 |
| JP | 2009-287150 | 12/2009 |
| JP | 2009-287152 | 12/2009 |
| WO | WO-2008/084372 | 7/2008 |
| WO | WO-2009/145042 | 12/2009 |
| WO | WO-2009/145043 | 12/2009 |

OTHER PUBLICATIONS

JP-2006-028654, Feb. 2006, Asada Sigenori, at al., translation.*
International Search Report mailed Jul. 14, 2009 directed towards PCT/JP2009/058178; 2 pages.
First Notice of Reasons for Rejection mailed Feb. 16, 2012, directed to Chinese Application No. 200980120097.7; 16 pages.
First Notice of Reasons for Rejection mailed Feb. 16, 2012, directed to Chinese Application No. 200980120213.5; 13 pages.
International Search Report mailed Jul. 14, 2009, directed towards Application No. PCT/JP2009/058719; 1 page.
Nozaki et al., Office Action dated Jun. 8, 2012, directed to U.S. Appl. No. 12/994,107; 10 pages.

* cited by examiner

*Primary Examiner* — Mark Halpern
(74) *Attorney, Agent, or Firm* — Morrison & Foerster LLP

(57) ABSTRACT

A process for producing a bulky paper with a concavo-convex pattern includes the steps of producing a wet mixed sheet comprising high-basis-weight regions and low-basis-weight regions from a paper-making material prepared by dispersing a fiber starting material and heat-expanding particles in water, the heat-expanding particles being evenly dispersed in the fiber in the high basis-weight and low basis-weight regions; and then heating the wet mixed sheet to cause expansion of the heat-expanding particles and form a concavo-convex pattern. This allows the free designing of concavo-convex sections on bulky papers.

7 Claims, 4 Drawing Sheets

BULKY PAPER WITH CONCAVO-CONVEX PATTERN AND PROCESS FOR PRODUCING THEREOF

REFERENCE TO RELATED APPLICATIONS

This application is the national stage under 35 USC 371 of International Application No. PCT/JP2009/058718, filed Apr. 28, 2009, which claims the priority of Japanese Patent Application No. 2008-143399, filed May 30, 2008, the entire contents of which are incorporated herein by reference.

The present invention relates to bulky paper with a concavo-convex pattern, and to a process for producing thereof.

BACKGROUND OF THE INVENTION

Japanese Patent Publication No. 60-59198 discloses a process for producing a sheet with a concavo-convex pattern obtained by thermal expansion of heat-expanding particles. Specifically, Japanese Patent Publication No. 60-59198 discloses anchoring heat-expanding particles in pulp and then aggregating them to form flock, dispersing the flock in a paper-making material containing no heat-expanding particles and making a paper, and then heating the obtained sheet to cause expansion of the heat-expanding particles to form a patterned sheet with a concavo-convex pattern wherein the flock-containing sections have become the expanded bulky sections.

SUMMARY OF INVENTION

According to the process disclosed in Japanese Patent Publication No. 60-59198, a sheet is formed by dispersing flock that contains heat-expanding particles in a paper-making material and causing thermal expansion of the heat-expanding particles to form a patterned sheet with a concavo-convex pattern wherein the flock-containing sections have become the bulky sections. Since the flock is dispersed in the paper-making material and paper is made from the material, the concavo-convex sections can only be formed in a random pattern, making it impossible to freely create designs of the concavo-convex sections.

The process of the invention is a process for producing a bulky paper with a concavo-convex pattern comprising the steps of producing a wet mixed sheet comprising high-basis-weight regions and low-basis-weight regions from a paper-making material prepared by dispersing a fiber starting material and heat-expanding particles in water, wherein the wet mixed sheet has the heat-expanding particles evenly dispersed in the fiber in the respective regions, and then heating the wet mixed sheet to cause expansion of the heat-expanding particles and form a concavo-convex pattern.

According to a preferred embodiment, the invention is characterized in that the paper-making material comprises 1-40 parts by mass of heat-expanding particles having a mean particle size of 5-30 μm before expansion and expanding 20- to 125-fold by volume upon heating, with respect to 100 parts by mass of a fiber starting material composed of 30-100% by mass natural pulp and 0-70% by mass other fiber. According to other preferred embodiment, the invention is characterized in that the density of the bulky paper is at least 0.01 g/cm$^3$ and less than 0.1 g/cm$^3$. According to other preferred embodiment, the invention is characterized in that partially blocked paper-making wire is used to produce a wet mixed sheet composed of high-basis-weight regions and low-basis-weight regions. According to other preferred embodiment, the invention is characterized in that the low-basis-weight regions are interspersed within the high-basis-weight regions. According to other preferred embodiment, the invention is characterized in that the high-basis-weight regions are interspersed within the low-basis-weight regions. According to other preferred embodiment, the invention is characterized in that the high-basis-weight regions and low-basis-weight regions are alternately arranged in a linear fashion in one direction of the sheet.

The bulky paper with a concavo-convex pattern according to the invention is obtained by producing a wet mixed sheet comprising high-basis-weight regions and low-basis-weight regions from a paper-making material prepared by dispersing in water 1-40 parts by mass of heat-expanding particles having a mean particle size of 5-30 μm before expansion and expanding 20- to 125-fold by volume upon heating, with respect to 100 parts by mass of a fiber starting material composed of 30-100% by mass natural pulp and 0-70% by mass other fiber, wherein the wet mixed sheet has the heat-expanding particles evenly dispersed in the fiber in the respective regions, and then heating the wet mixed sheet to cause expansion of the heat-expanding particles.

According to the invention, a paper-making material having heat-expanding particles evenly mixed throughout is screened using partially blocked paper-making wire to obtain a sheet comprising low-basis-weight regions and high-basis-weight regions compared to the average basis weight, and the sheet is thermally expanded, thus obtaining paper with a larger apparent thickness than paper with a uniform basis weight having the same average basis weight. The process is economically advantageous since a sheet with an apparent thickness equivalent to a high basis weight can be obtained without increasing the basis weight.

The bulky paper of the invention has a density of less than 0.1 g/cm$^3$, and preferably no greater than 0.05 g/cm$^3$. Low density sheets of the same level, such as airlaid pulp non-woven fabrics commonly used as materials for absorption cores in absorbent articles because of their bulky properties and liquid retention properties, have been associated with the disadvantage of poor liquid diffusibility and the disadvantage of decreased bulk under wet pressure. The bulky paper of the invention, however, exhibits bulkiness by expansion of the heat-expanding particles, the fiber sections maintaining a relatively high-density state while the gaps are blocked by the balloons of the expanded heat-expanding particles. Therefore, not only is there no decrease in bulk, but repulsion elasticity against pressure is also exhibited so that when the sheet is used as the absorption core of an absorbent article such as a paper diaper or sanitary product, the product undergoes minimal twisting.

DETAILED DESCRIPTION OF THE INVENTION

Figure 1:
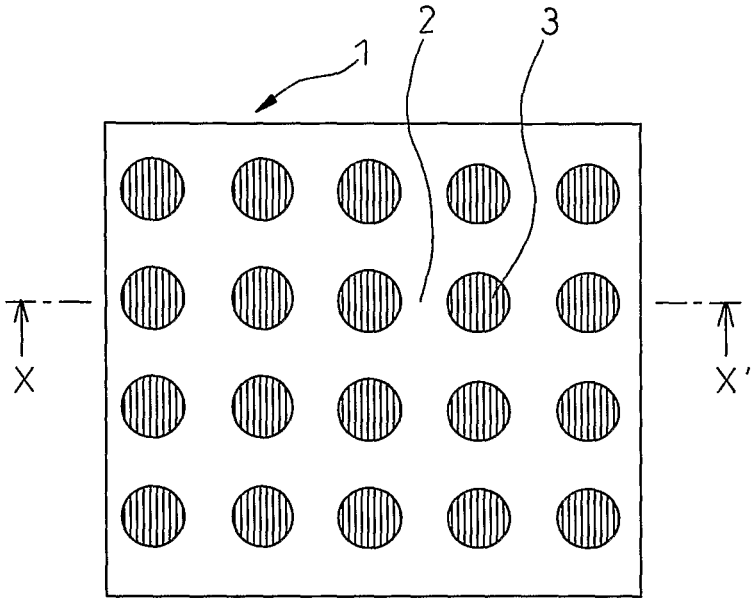
FIG. 1 is a plan view of an embodiment of a bulky paper with a concavo-convex pattern according to the invention.

The invention will now be described in greater detail with reference to the accompanying drawings, with the understanding that the invention is not limited to the examples depicted in the drawings.

Figure 2:
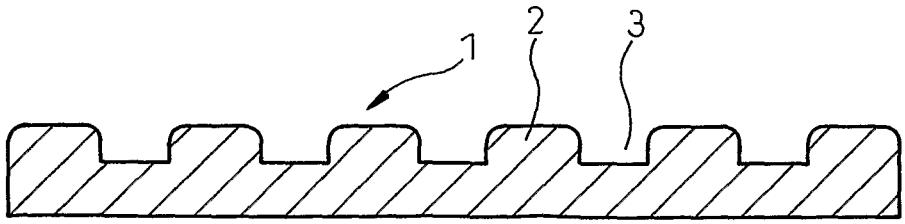
FIG. 2 is a cross-sectional view of an embodiment of a bulky paper with a concavo-convex pattern according to the invention.

FIG. 1 is a plan view of an embodiment of a bulky paper 1 with a concavo-convex pattern according to the invention, and FIG. 2 is a cross-sectional view along line X-X'. The bulky paper 1 with a concavo-convex pattern according to the invention is composed of high-basis-weight regions 2 and low-basis-weight regions 3.

Figure 3:
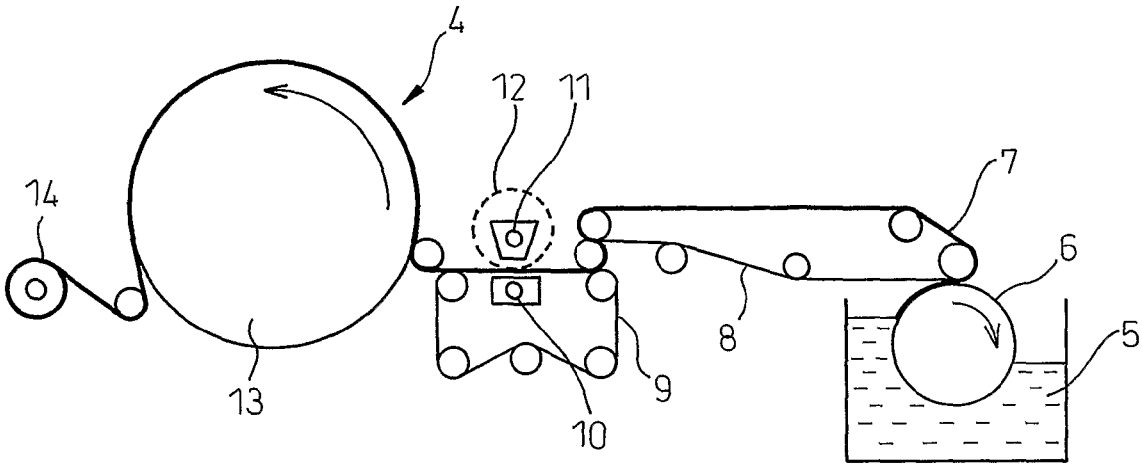
FIG. 3 is a simplified view of a paper machine depicted as being used for actual production.

FIG. 3 is a simplified view of a paper machine 4 used in the production process of the invention. The paper machine 4 comprises a paper-making material liquid 5, a paper-making cylinder 6, a first conveyor belt 8, a second conveyor belt 9, a suction box 10, a spray nozzle 11, a screen drum 12, a dryer 13 and a finished product take-up roll 14. A paper-making cylinder 6 is used to make a wet mixed sheet 7 comprising high-basis-weight regions and low-basis-weight regions from a paper-making material liquid 5 obtained by dispersing a fiber starting material and heat-expanding particles in water, wherein the wet mixed sheet 7 is conveyed by a first conveyor belt 8 and a second conveyor belt 9, the wet mixed sheet 7 is subsequently heated by moist hot air or water vapor from the spray nozzle 11 to cause expansion of the heat-expanding particles, the sheet is then dried with the dryer 13, and the finished bulky paper is taken up with a finished product take-up roll 14 to obtain a bulky paper with a concavo-convex pattern.

Figure 4:
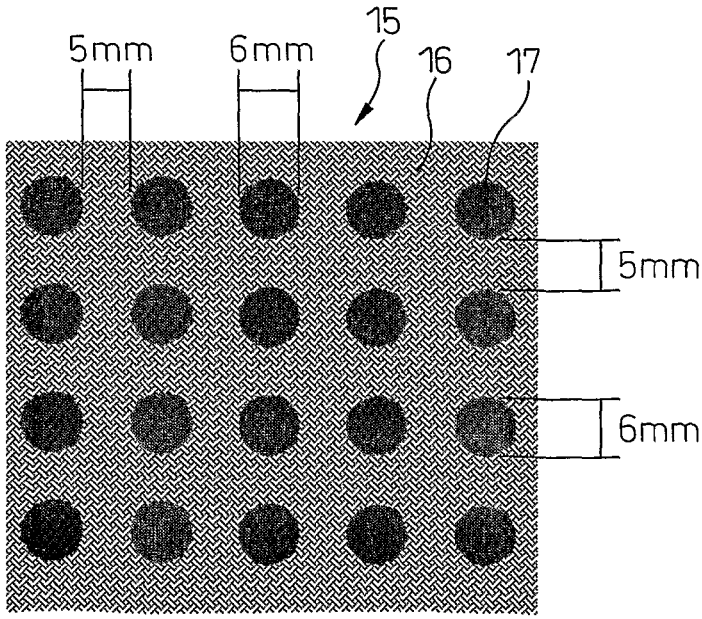
FIG. 4 is a plan view of paper-making wire for obtaining a bulky paper having low-basis-weight regions interspersed within high-basis-weight regions.

FIG. 4 is a plan view of an embodiment of paper-making wire 15 used in the production process of the invention. The paper-making wire 15 is composed of non-blocked sections 16 and blocked sections 17. The blocked sections 17 are round with diameters of 6 mm and are arranged on the paper-making wire at 5 mm spacings. Using the paper-making wire 15 shown in FIG. 4 can yield a bulky paper having low-basis-weight regions interspersed within high-basis-weight regions. The area ratio of the blocked sections 17 is 23.4% with respect to the entire paper-making wire 15.

Figure 5:
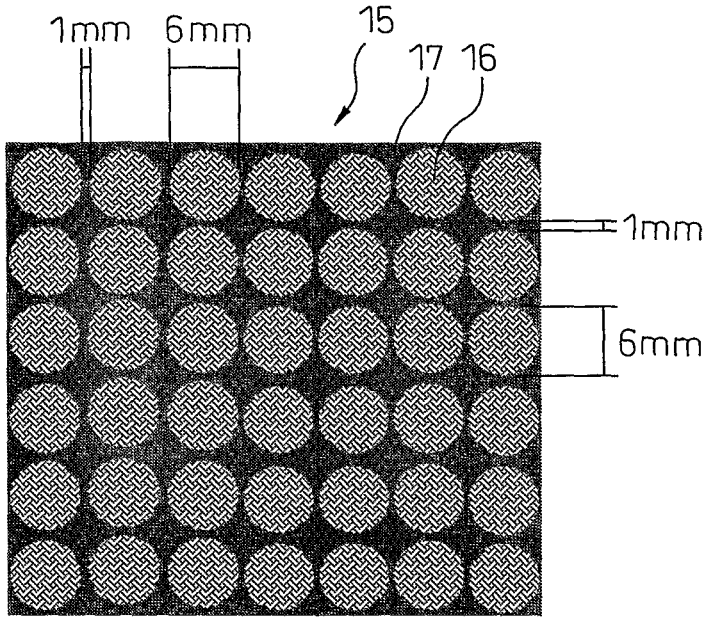
FIG. 5 is a plan view of paper-making wire for obtaining a bulky paper having high-basis-weight regions interspersed within low-basis-weight regions.

FIG. 5 is a plan view of another embodiment of paper-making wire 15 used in the production process of the invention. The paper-making wire 15 is composed of non-blocked sections 16 and blocked sections 17. The non-blocked sections 16 are round with diameters of 6 mm and are arranged on the paper-making wire at 1 mm spacings. Using the paper-making wire 15 shown in FIG. 5 can yield a bulky paper having high-basis-weight regions interspersed within low-basis-weight regions. The area ratio of the blocked sections 17 is 42.3% with respect to the entire paper-making wire 15.

Figure 6:
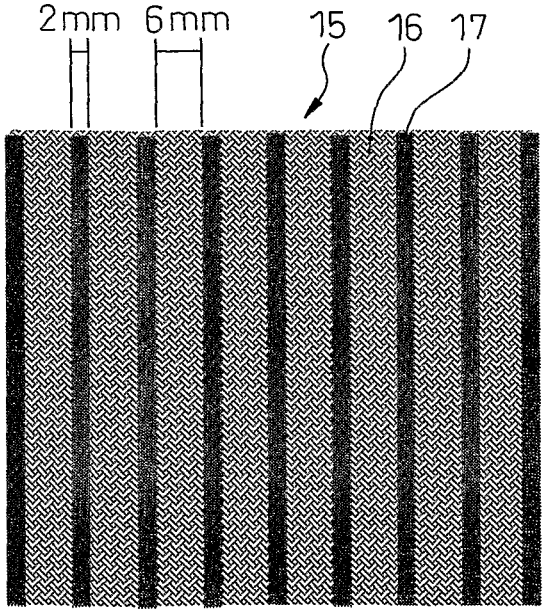
FIG. 6 is a plan view of paper-making wire for obtaining a bulky paper having high-basis-weight regions and low-basis-weight regions arranged as lines in an alternating fashion in one direction.

FIG. 6 is a plan view of yet another embodiment of paper-making wire 15 used in the production process of the invention. Linear blocked sections 17 with 2 mm widths and linear non-blocked sections 16 with 6 mm widths are arranged in an alternating fashion. Using the paper-making wire 15 shown in FIG. 6 can yield a bulky paper having high-basis-weight regions and low-basis-weight regions arranged as alternating lines in one direction. The area ratio of the blocked sections 17 is 25% with respect to the entire paper-making wire 15.

The fiber starting material used for the invention may be any one ordinarily used for paper making, and examples include natural pulp, synthetic pulp, organic fiber and inorganic fiber. For example, the fiber starting material may consist of 30-100% by mass natural pulp and 0-70% by mass fiber selected from the group consisting of synthetic pulp, organic fiber and inorganic fiber. From the viewpoint of paper making properties, a pulp content of 50% by mass or greater will result in superior sheet formation and strength. The natural pulp may be wood pulp such as chemical pulp or mechanical pulp from a conifer or broadleaf tree, waste paper pulp, or nonwood natural pulp such as hemp or cotton, although there is no restriction to these. As synthetic pulp there may be mentioned synthetic pulp obtained from polyethylene or polypropylene starting materials, although there is no limitation to these. As organic fiber there may be mentioned acrylic fiber, rayon fiber, phenol fiber, polyamide fiber and polyethylene fiber, with no limitation to these. As inorganic fiber there may be mentioned glass fiber, carbon fiber, alumina fiber and the like, with no limitation to these.

The heat-expanding particles used for the invention are heat-expanding particles obtained by encapsulating a low boiling point solvent in microcapsules. The capsules are particles with a mean particle size of 5-30 μm and preferably 8-14 μm before expansion, which expand 20- to 125-fold and preferably 50- to 80-fold by volume upon brief heating at a relatively low temperature of 80-200° C. The heat-expanding particles are obtained by encapsulating a volatile organic solvent (expanding agent) such as isobutane, pentane, petroleum ether, hexane, a low-boiling-point halogenated hydrocarbon or methylsilane as the low boiling point solvent, with a thermoplastic resin composed of a copolymer such as vinylidene chloride, acrylonitrile, an acrylic acid ester, a methacrylic acid ester or the like, and upon heating at above the softening point of the film polymer of the microcapsules, the film polymer begins to soften causing the vapor pressure of the encapsulated expanding agent to increase simultaneously, so that the film is pushed outward resulting in expansion of the capsules. The heat-expanding particles expand at relatively low temperature and in a short period of time to form closed cells, thus providing a material with excellent thermal insulation properties, which is also relatively manageable and suitable for the present purpose. As such heat-expanding particles there are known Matsumoto Microsphere F-36, F-30D, F-30GS, F-20D, F-50D and F-80D (product of Matsumoto Yushi-Seiyaku Co., Ltd.) and EXPANCEL WU and DU (product of Sweden, marketed by Japan Fillite Co., Ltd.), although there is no limitation to these. The heat-expanding particle content is 1-40 parts by mass and preferably 3-20 parts by mass with respect to 100 parts by mass of the pulp fiber, because at less than 1 part by mass the expansion will not be sufficient, while economical disadvantages are presented at greater than 40 parts by mass.

The pulp slurry may further contain various anionic, nonionic, cationic or amphoteric yield improvers, paper strength additives, sizing agents and the like, selected as appropriate. Specifically, as paper strength additives and yield improvers there may be used combinations of organic compounds such as polyacrylamide-based cationic, nonionic, anionic and amphoteric resins, polyethyleneimine and its derivatives, polyethylene oxide, polyamines, polyamides, polyamide-polyamine and its derivatives, cationic and amphoteric starch, oxidized starch, carboxymethylated starch, vegetable gum, polyvinyl alcohol, urea-formalin resin, melamine-formalin resin and hydrophilic polymer particles, and inorganic compounds including aluminum compounds such as aluminum sulfate, alumina sol, basic aluminum sulfate, basic aluminum chloride and basic polyaluminum hydroxide, and iron(II) sulfate, iron(II) chloride, colloidal silica, bentonite or the like.

In the paper-making process of the invention, the starting slurry obtained by mixing within water in the prescribed proportions is sheeted with a wire part and then dewatered with a press part. The paper-making wire used may be 70-100 mesh and preferably 80 mesh. The paper-making wire, if it is partially blocked wire, can produce a wet mixed sheet comprising partial low-basis-weight regions with small amounts of paper-making material and partial high-basis-weight regions with large amounts of paper-making material. Specifically, the paper-making material flows poorly at the blocked sections and fails to accumulate, thus forming partial low-basis-weight regions with small amounts of paper-making material, while the paper-making material flows easily at the non-blocked sections and readily accumulates, thus forming partial high-basis-weight regions with large amounts of paper-making material. According to the invention, the partial regions with small amounts of paper-making material and a lower basis weight than the average basis weight are the low-basis-weight regions, while the partial regions with large amounts of paper-making material and a higher basis weight than the average basis weight are the high-basis-weight regions. If the heat-expanding particles are evenly dispersed in the paper-making material as according to the invention, the heat-expanding particles will be present in about the same proportion in the low-basis-weight regions and high-basis-weight regions, so that heating will cause expansion to produce bulk equally in both. The apparent bulk of the paper in the high-basis-weight regions having a higher basis weight than the average basis weight is larger than the average basis weight, while the low-basis-weight regions are the opposite. It is therefore possible to obtain a bulky paper with high apparent bulk in a large concavo-convex pattern. Blocking of the wire can be accomplished using a reaction curing resin or the like, and the sizes, number, shapes and arrangement thereof may be freely designed. For example, the blocked regions may be interspersed in the non-blocked regions, the non-blocked regions may be interspersed in the blocked regions, or the non-blocked regions and blocked regions may be arranged in an alternating linear fashion in one direction of the sheet. Low-basis-weight regions do not form as easily with a smaller single blocking size, while low-basis-weight regions form more easily at larger sized sections. If the single blocking size is too small, the blocked sections will become covered with the paper-making material, filling in the blocked sections and thus preventing formation of low-basis-weight regions. On the other hand, if the single blocking size is too large, uniform low-basis-weight regions will not form but rather open sections without paper-making material will tend to be created, tending to result in tearing at the open sections during movement from the paper-making wire to the conveyor belt, thus impeding movement. The optimum range for the single blocking size cannot be specified since it will vary depending on the basis weight of the sheet. The area ratio of the blocked sections with respect to the total wire may be varied as necessary, but a larger area ratio is more effective for improving the apparent bulk of the sheet, whereas a smaller one reduces the apparent bulk. If the area ratio is too large, the starting material will concentrate excessively at the non-blocked sections during paper making, thus interfering with production of the sheet. The area ratio of the blocked sections with respect to the total wire will vary depending on the blocking pattern, but may be 10%-60% and preferably 20%-50%.

In an ordinary paper-making process, the moisture content is usually brought to around 60% by mass of the paper-making material by dewatering, but the moisture content is preferably adjusted by the degree of expansion of the heat-expanding particles. When expansion is carried out simultaneously with drying, a larger moisture content is preferred so that expansion is completed before drying produces bonding force between the fibers. In this case, the dewatering pressure may be reduced for a moisture content of 60% by mass or greater, but a high moisture content exceeding 100% by mass can result in drying efficiency problems. When employing a method in which drying is carried out after expansion has been completed, it is necessary for the temperature of the sheet as a whole to be raised to the initial expansion temperature in an efficient manner using moist hot air or water vapor so that the wet mixed sheet does not dry at the expansion stage, and therefore the moisture content is preferably as low as possible, such as 40-60% by mass. If necessary, the common dewatering method of press dewatering may be combined with a different type of dewatering method such as, for example, evaporation dewatering with warm air below the initial expansion temperature of the heat-expanding particles. However, even a high moisture content will not present any problem in the completed state, despite some reduction in thermal efficiency.

In the thermal expansion step of the invention, heating may be conducted at a temperature above the initial expansion temperature of the heat-expanding particles in order to cause expansion of the heat-expanding particles. A simple method may utilize heat for drying to cause expansion of the heat-expanding particles simultaneously with the drying. In this method, bonding between fibers during drying will inhibit expansion of the heat-expanding particles, and therefore some modification is necessary to maximize the moisture content of the wet mixed sheet. Even with a high moisture content, however, the sheet will often dry before the heat-expanding particles have sufficiently expanded, and therefore this method cannot be considered suitable for obtaining sufficient bulk. As an optimal thermal expansion process for exhibiting greater bulk, the sheet may be heated without drying for expansion of the heat-expanding particles, and then drying performed in a separate drying step. Since no bonding force is be produced between fibers in the expansion step for the heat-expanding particles in this method, the bulk of the sheet is not inhibited by expansion of the heat-expanding particles and sufficient bulk can be exhibited. If the sheet is placed on a support and suction is applied from the bottom of the support while spraying moist hot air or water vapor from the top side, the entire sheet will be heated rapidly and evenly, thereby increasing the thermal expansion effect, and therefore this method may be considered to be most efficient. The support may be, but is not limited to, a net or other type of conveyor belt. When steam is sprayed onto the sheet from a nozzle hole positioned at a prescribed spacing from it in a method that involves spraying moist hot air or water vapor, an excessively high moisture content of the sheet (about 80% by mass or greater) will produce uneven expansion due to the pitch of the nozzle hole regardless of whether the sheet surface is at uniform temperature, for this reason a lower moisture content of the sheet is preferred. When steam is evenly sprayed onto the entire sheet, on the other hand, the moisture content of the sheet is not restricted if the steam spraying is accomplished using a slit nozzle, for example, although the moisture content is preferably as low as possible from the viewpoint of thermal efficiency.

The wet expanded sheet that has been thermally expanded is then sent to a drying step for drying. Although an ordinary drying method of the prior art may be used for drying, it is essential to avoid crushing the sheet with a strong press.

The temperature of the moist hot air or water vapor used for the invention may be above the temperature at which the microcapsule shell walls of the heat-expanding particles soften and begin to expand, and it will be determined by the heat-expanding particles used. The relative humidity is preferably 100% in order to prevent drying of the wet mixed sheet during the thermal expansion step, but it does not necessarily need to be 100%. The method of supplying the moist hot air or water vapor is most preferably a method in which high-temperature steam from a boiler is ejected and directly sprayed onto the sheet, but moist exhaust from the drier may also be used.

The density of the bulky paper of the invention is at least 0.01 g/cm$^3$ and less than 0.1 g/cm$^3$, and preferably at least 0.01 g/cm$^3$ and no greater than 0.05 g/cm$^3$. The density of the bulky paper of less than 0.01 g/cm$^3$ is not practical because the strength will be reduced and tearing will easily occur, tending to cause problems with surface friction durability. As mentioned above, the arrangement of the high-basis-weight regions and low-basis-weight regions of the bulky paper can be freely designed by varying the blocked sections and non-blocked sections of the wire. The arrangement of the high-basis-weight regions and low-basis-weight regions of the bulky paper may be regular or irregular, appropriately selected according to the purpose of the bulky paper. Uses of the bulky paper of the invention include paper diapers and sanitary napkins, as well as cut packaging sheets, packing cushion sheets, wiping sheets and the like.

EXAMPLE

The present invention will be explained in greater detail by examples, with the understanding that the invention is in no way limited by the Examples.

Example 1

Figure 7:
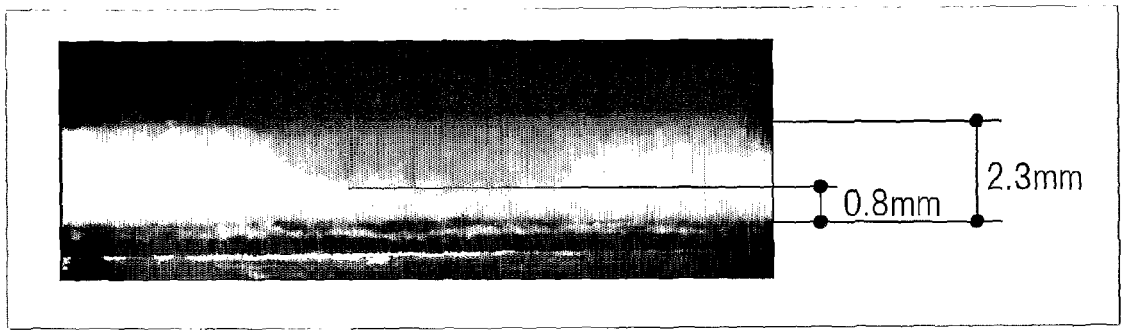
FIG. 7 is a cross-sectional view of the bulky paper obtained in Example 1.

To a pulp slurry obtained by dispersing 85 parts by mass of conifer bleached Kraft pulp in water there were added 15 parts by mass of Matsumoto Microsphere F-36 (product of Matsumoto Yushi-Seiyaku Co., Ltd., particle size: 5-15 μm, initial expansion temperature: 75-85° C.) as heat-expanding particles, 0.2 part by mass of FILEX RC-104 (product of Meisei Chemical Works, Ltd., cation-modified acrylic copolymer) as a heat-expanding particle anchoring agent and 0.2 part by mass of FILEX M (product of Meisei Chemical Works, Ltd., acrylic copolymer) while stirring, to obtain a paper-making material with a pulp concentration of 1.0% by mass. The obtained paper-making material was used to make paper with a basis weight of 50 g/m$^2$ using a rectilinear hand-sheet machine (80 mesh) according to a common method, and the paper was dewatered by sandwiching between filter sheets to obtain a wet mixed sheet with a moisture content of 60% by mass. The paper-making wire of the handsheet machine was the paper-making wire shown in FIG. 4. The wet mixed sheet made was placed on a conveyor belt and transported at a speed of 5 m/min. During this time, suction was applied from the bottom of the conveyor belt and water vapor obtained from a boiler (nozzle manifold internal temperature: 172-174° C., pressure: 0.82-0.85 MPa) was sprayed from a nozzle (hole diameter: 0.3 mm, hole pitch: 2 mm, single row arrangement) through a 90 mesh wire mesh, from the top side of the wet mixed sheet, to cause expansion of the sheet. Next, the sheet was dried with a rotary dryer set to 120° C., without applying strong pressure thereto, to obtain a bulky paper with a basis weight of 50 g/m$^2$. A cross-sectional view of the obtained bulky paper is shown in FIG. 7. It had a concavo-convex pattern with depressed low-basis-weight regions in a circular island pattern interspersed in high-basis-weight regions, and the degree of expansion of the heat-expanding particles was approximately the same in both regions. The high-basis-weight regions had a basis weight of about 59.1 g/m$^2$, a thickness of about 2.3 mm and a density of about 0.026 g/cm$^3$, while the low-basis-weight regions had a basis weight of about 20 g/m$^2$, a thickness of about 0.8 mm and a density of about 0.025 g/cm$^3$.

Example 2

Figure 8:
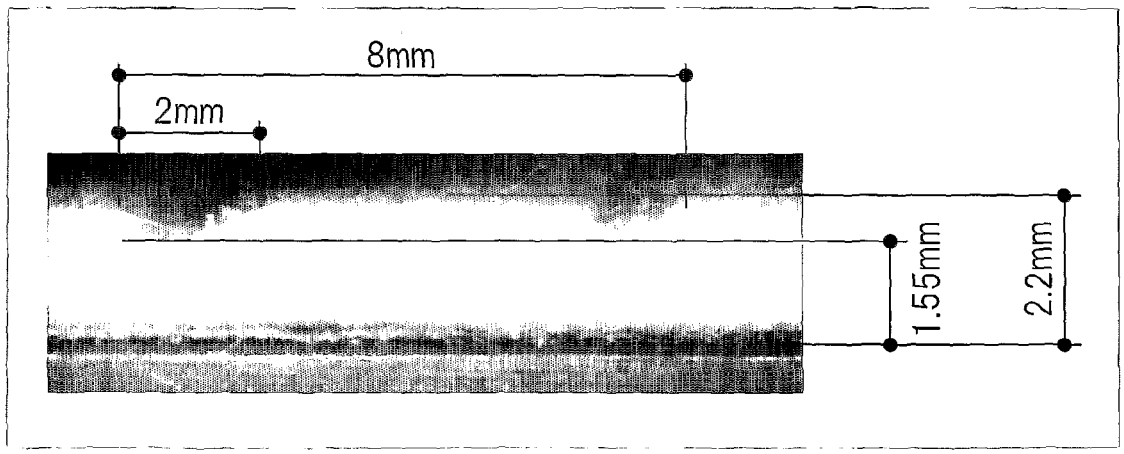
FIG. 8 is a cross-sectional view of the bulky paper obtained in Example 2.

A bulky paper was obtained by the same procedure as Example 1, except that the paper-making wire shown in FIG. 6 was used. A cross-sectional view of the obtained bulky paper is shown in FIG. 8. It had a concavo-convex pattern with depressed low-basis-weight regions with widths of about 2 mm arranged in a linear fashion within the high-basis-weight regions at a pitch of about 8 mm. The high-basis-weight regions had a basis weight of about 57 g/m$^2$, a thickness of about 2.2 mm and a density of about 0.026 g/cm$^3$, while the low-basis-weight regions had a basis weight of about 30 g/m$^2$, a thickness of about 1.55 mm and a density of about 0.019 g/cm$^3$.

Comparative Example 1

A bulky paper with a basis weight of 51 g/m$^2$ was obtained with the same materials and procedure as in Example 1, except that a non-blocked paper-making wire was used. The thickness of the obtained sheet was 1.95 mm and the density was 0.026 g/cm$^3$.

The invention claimed is:

1. A process for producing a bulky paper with a concavo-convex pattern, comprising:

producing a wet mixed sheet comprising high-basis-weight regions and low-basis-weight regions from a paper-making material prepared by dispersing a fiber starting material and heat-expanding particles in water, the heat-expanding particles being evenly dispersed in the fiber in the high basis-weight and low basis-weight regions;

heating the wet mixed sheet to cause expansion of the heat-expanding particles and form a concavo-convex pattern; and then drying the wet mixed sheet.

2. The process according to claim 1, wherein the paper-making material comprises 1-40 parts by mass of heat-expanding particles having a mean particle size of 5-30 μm before expansion and expanding 20- to 125-fold by volume upon heating, with respect to 100 parts by mass of a fiber starting material composed of 30-100% by mass natural pulp and 0-70% by mass other fiber.

3. The process according to claim 1 or 2, wherein the density of the bulky paper is at least 0.01 g/cm$^3$ and less than 0.1 g/cm$^3$.

4. The process according to claim 1 or 2, comprising using a partially blocked paper-making wire to produce the wet mixed sheet composed of high-basis-weight regions and low-basis-weight regions.

5. The process according to claim 1 or 2, wherein the low-basis-weight regions are interspersed within the high-basis-weight regions.

6. The process according to claim 1 or 2, wherein the high-basis-weight regions are interspersed within the low-basis-weight regions.

7. The process according to claim 1 or 2, wherein the high-basis-weight regions and low-basis-weight regions are alternately arranged in a linear fashion in one direction of the sheet.

* * * * *